US008607885B2

(12) United States Patent
Rennie et al.

(10) Patent No.: US 8,607,885 B2
(45) Date of Patent: Dec. 17, 2013

(54) FIRE SUPPRESSOR CYLINDERS WITH ENHANCED BUBBLE PRODUCTION

(75) Inventors: Paul Rennie, Bracknell (GB); Robert Pallant, Slough (GB)

(73) Assignee: Kidde Technologies, Inc., Wilson, NC (US)

( * ) Notice: Subject to any disclaimer, the term of this patent is extended or adjusted under 35 U.S.C. 154(b) by 418 days.

(21) Appl. No.: 12/551,707

(22) Filed: Sep. 1, 2009

(65) Prior Publication Data

US 2011/0005780 A1 Jan. 13, 2011

(30) Foreign Application Priority Data

Jul. 10, 2009 (GB) ..... 0912100.5

(51) Int. Cl.

| | |
|---|---|
| ***A62C 35/13*** | (2006.01) |
| ***A62C 35/11*** | (2006.01) |
| ***A62C 35/02*** | (2006.01) |
| ***A62C 35/00*** | (2006.01) |
| ***A62C 13/64*** | (2006.01) |
| ***A62C 13/00*** | (2006.01) |

(52) U.S. Cl.
USPC ..... 169/9; 169/71; 169/76

(58) Field of Classification Search
USPC ..... 169/9, 30, 44, 71, 76; 220/581, 586, 220/592, 608, 623, 669, 670; 239/373
See application file for complete search history.

(56) References Cited

U.S. PATENT DOCUMENTS

| | | | | |
|---|---|---|---|---|
| 822,546 | A | 6/1906 | Newman | |
| 1,370,661 | A | 3/1921 | Maxwell | |
| 1,595,413 | A | 8/1926 | Meloon | |
| 4,417,626 | A | 11/1983 | Hansen | |
| 4,664,199 | A | 5/1987 | Grant et al. | |
| 4,930,579 | A | 6/1990 | George | |
| 4,940,337 | A * | 7/1990 | Nakaji et al. | 366/148 |
| 4,986,366 | A | 1/1991 | O'Connell | |
| 5,377,872 | A | 1/1995 | Mauney | |
| 5,678,637 | A | 10/1997 | O'Connell | |
| 6,241,164 | B1 * | 6/2001 | Wolfe | 239/303 |
| 6,527,058 | B1 | 3/2003 | Nerat | |
| 6,902,009 | B1 | 6/2005 | Meserve et al. | |
| 7,080,695 | B2 | 7/2006 | Gwak | |
| 7,341,238 | B2 | 3/2008 | Karalis et al. | |
| 2006/0016608 | A1 | 1/2006 | Simpson et al. | |
| 2006/0278411 | A1 * | 12/2006 | Manthey et al. | 169/44 |

FOREIGN PATENT DOCUMENTS

| | | |
|---|---|---|
| CN | 2497811 Y | 7/2002 |
| EP | 0685240 A2 | 6/1995 |
| EP | 1728535 A2 | 6/2006 |

(Continued)

OTHER PUBLICATIONS

EP Search Report dated Nov. 11, 2010.

(Continued)

*Primary Examiner* — Darren W Gorman

(74) *Attorney, Agent, or Firm* — Carlson, Gaskey & Olds, PC

(57) ABSTRACT

A fire suppression cylinder includes a valve at an outlet of a canister, and a control for the valve. The canister receives a liquid suppressor agent and a pressurized gas. A feature within a portion of the canister will receive the liquid suppressor agent. The feature increases the formation of gas bubbles within the liquid suppressor agent.

15 Claims, 2 Drawing Sheets

(56) References Cited

FOREIGN PATENT DOCUMENTS

| | | | |
|---|---|---|---|
| FR | 2342753 | A2 | 1/1974 |
| FR | 2676011 | A1 | 5/1991 |
| GB | 486113 | A | 5/1938 |
| JP | 3123836 | A | 5/1991 |
| JP | 4028379 | A | 1/1992 |
| SU | 760985 | A1 | 6/1978 |
| SU | 1157261 | A1 | 1/1984 |
| SU | 1340760 | A1 | 5/1986 |
| WO | 2009100541 | A1 | 8/2009 |

OTHER PUBLICATIONS

UK Search/Exam Report dated Nov. 11, 2009.
Singapore Search Report dated Mar. 12, 2012.
Search Report for ROC (Taiwan) Patent Application No. 099118242 completed on May 27, 2013.

* cited by examiner

FIRE SUPPRESSOR CYLINDERS WITH ENHANCED BUBBLE PRODUCTION

RELATED APPLICATION

This application claims priority to GB Patent Application No. 0912100.5, which was filed Jul. 10, 2009.

BACKGROUND OF THE INVENTION

This application relates to a type of fire suppressor wherein a liquid suppressor agent is driven out of a canister by the formation of gas bubbles.

Fire suppressors are known, and include a variety of agents that are discharged toward a fire. One type of high discharge rate fire suppressor uses rapid desorption of a pressurizing agent, which is typically pressurized nitrogen or carbon dioxide, from a volatile liquid agent, to drive the liquid agent out of the suppressor canister.

Typically, a valve is triggered to open, and bubbles of a dissolved gas rapidly form in the agent creating a foaming mixture that expands and discharges from the suppressor canister. The formation of this foam is of critical importance to the effective deployment of the agent.

Recent studies of the phenomenon have indicated that the proportion of agent discharged decreases as the temperature decreases. This is believed to be due to a combination of thermodynamic and kinetic effects. Some gases become less soluble in the liquid agent at low temperatures, but also the rate of bubble formation will change.

In order to grow, the bubbles must overcome a pressure inside the suppressor and also the resistance caused by the surface tension of the liquid, which increases at low temperature. Tests have suggested that the initial formation of bubbles may be the rate-determining step at these low temperatures, particularly for a highly soluble gas.

It is known to provide nucleation sites on a surface to form gas bubbles. One example of a nucleation site is the inclusion of surface imperfections on champagne flutes. Such a site can provide a surface where gas molecules can agglomerate.

However, nucleation sites have not been utilized in fire suppression cylinders.

SUMMARY OF THE INVENTION

A fire suppression cylinder includes a valve at an outlet of a canister, and a control for the valve. The canister receives a liquid suppressor agent and a pressurized gas. A feature is provided within a portion of the canister that will receive the liquid suppressor agent. The feature increases the formation of gas bubbles within the liquid suppressor agent.

These and other features of the present invention can be best understood from the following specification and drawings, the following of which is a brief description.

DETAILED DESCRIPTION OF THE PREFERRED EMBODIMENT

Figure 1:
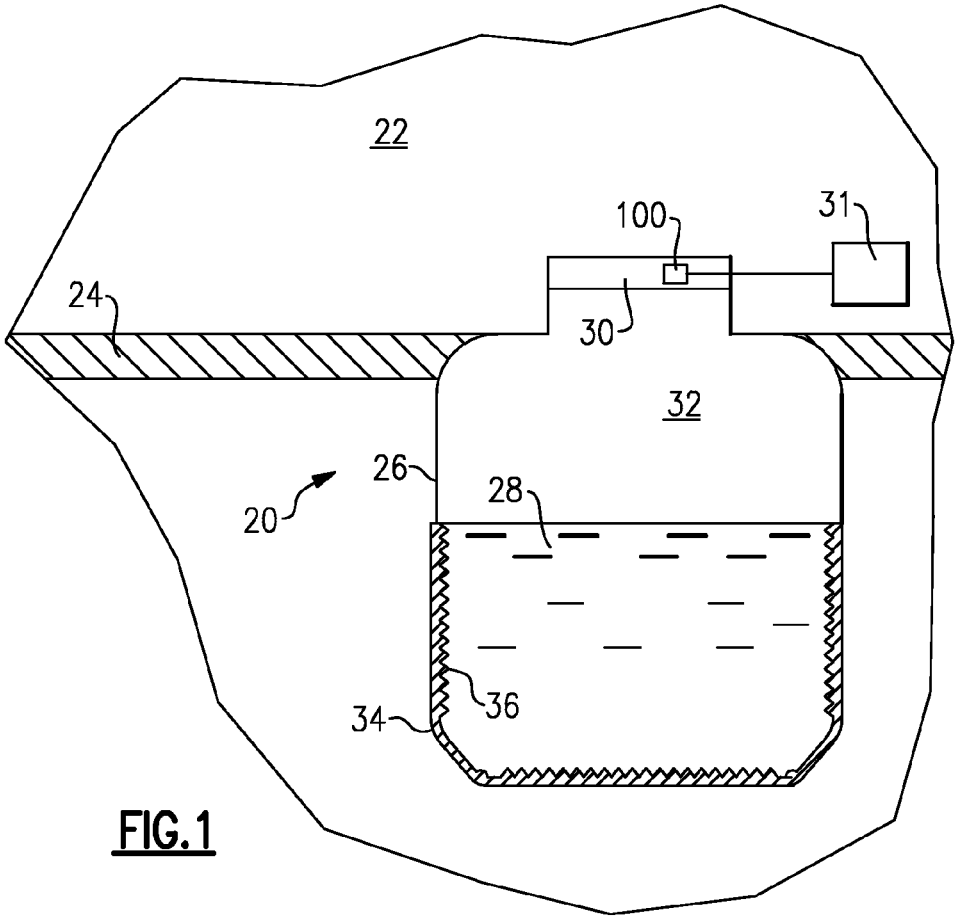
FIG. 1 shows a first embodiment of the present invention.

A fire suppression cylinder 20 is illustrated in FIG. 1. Such a module may be included in the wall 24 of a vehicle, such as a ground vehicle or aircraft. As is clear, the cylinder 20 is fixed relative to the wall 24. An area 22 to be maintained free of fire is associated with the module 20. A valve 30 is selectively controlled by a control 31 to open, and allow an agent to be directed into the area 22. The operation of the valve 30 and the control 31 may be as disclosed in U.S. Patent Application Publication 2006-0016608, the disclosure of which is incorporated by reference. In particular, the valve 30 would include an actuator 100 (shown schematically) actuated by control 31 to open the valve 30 and dispense the suppressor agent through a nozzle. The control 31 includes a detection system for detecting an event, such as an explosion in the ground vehicle or aircraft. This is particularly applicable to military vehicles. While the fire suppression cylinder is shown with its nozzle extending through wall 24, it may be more common for the cylinder to be mounted in a bracket on an outer side of the wall, with an opening extending through the wall. The actuator 100 may comprise one of a solenoid actuator, an electric protractor actuator, a metron actuator, or any other suitable form of actuator. The detection system may detect infra-red radiation, and may be able to detect an explosion within two milliseconds of it occurring. The detection system may comprise one of a single IR-sensor, a dual IR-sensor, a UV sensor or a combined UV and IR sensor.

The module 20 includes a canister 26 receiving a liquid agent 28, and a gas 32. The agent 28 includes some dissolved gas. A lower portion of the walls 34 of canister 26 is roughened, such as is shown in exaggerated size at 36. The size of the imperfections on the metal wall of the canister 26 is exaggerated as shown at 36 to illustrate the fact of the roughened surfaces. The surfaces may be roughened after formation of the lower portion 34, or roughened as part of their manufacture. The height of the lower portion may correspond to the approximate level of the liquid agent 28. Alternatively, the entire surface of the canister may be roughened.

In embodiments, the roughened portions 36 may stand out at a height of 1 mm or less or, more narrowly, approximately 0.1 mm to 0.5 mm.

Figure 2:
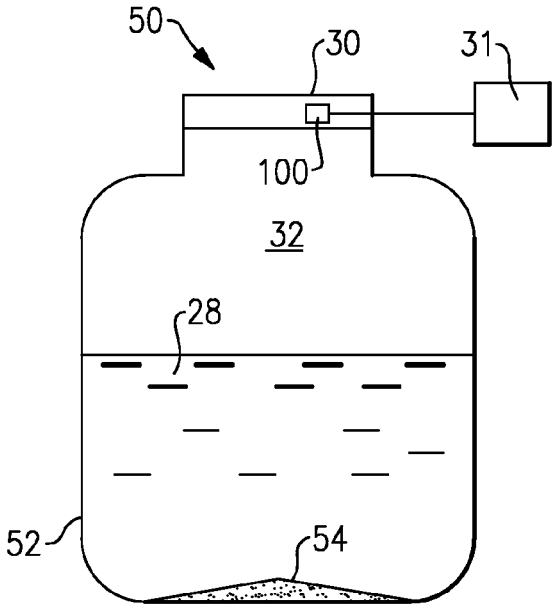
FIG. 2 shows a second embodiment of the present invention.

FIG. 2 shows another embodiment 50 wherein a canister 52 receives a powder 54 within its liquid suppressor agent 28. The powder is selected such that it does not react with, or dissolve in, the liquid agent 28, and is of a sufficiently fine grain that it will provide a nucleation site, but not interfere with the suppressor otherwise. Examples powders may be silica, alumina, talc, mica, sodium bicarbonate, potassium bicarbonate, and ammonium dihydrogen phosphate.

Figure 3:
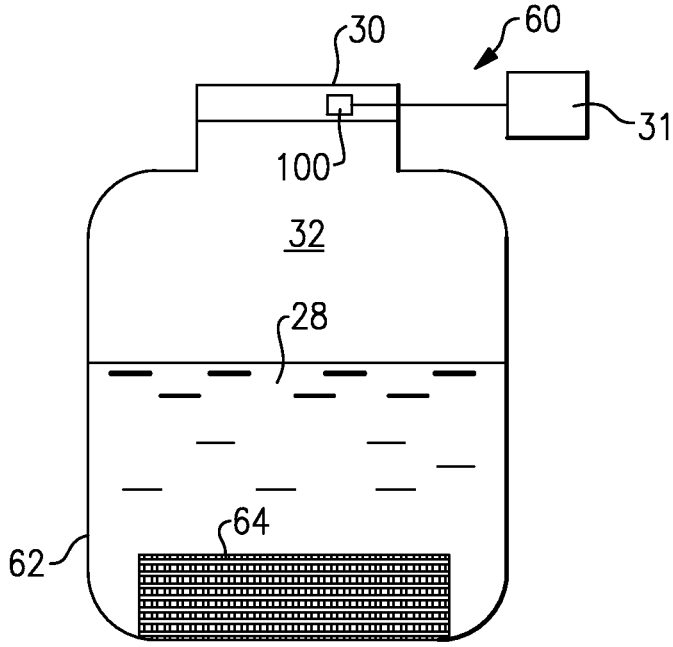
FIG. 3 shows a third embodiment of the present invention.

FIG. 3 shows yet another embodiment 60, wherein the canister 62 is provided with an included surface 64. The included surface 64 is selected such that it will not react with the liquid suppressor agent 28. In an illustrated embodiment, a 3-D mesh material is utilized. Again, the 3-D surfaces will provide nucleation sites.

While several embodiments have been shown, another way of forming the roughened surface, in the FIG. 1 embodiment for example, would be to simply attach a rough lining to the inside of the cylinder. In such an embodiment, the material utilized to provide the lining would also preferably be selected such that it would not react with or dissolve in the liquid agent, as is the powder of the FIG. 2 embodiment.

Figure 4:
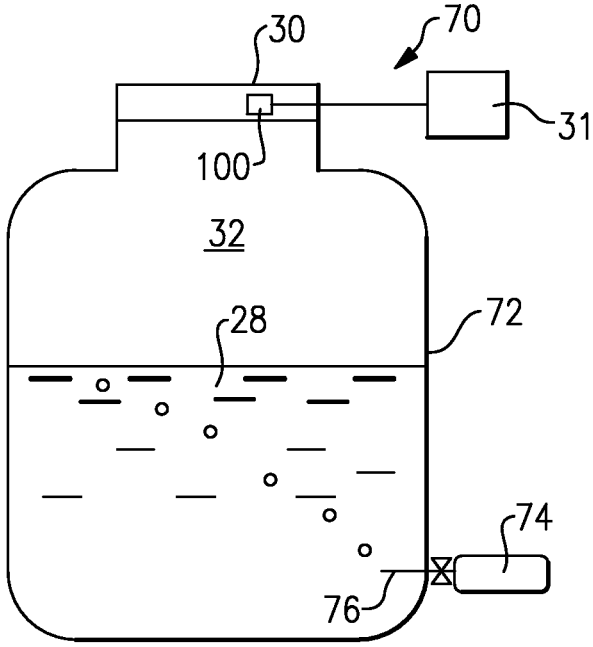
FIG. 4 shows a fourth embodiment of the present invention.

FIG. 4 shows yet another embodiment 70 wherein the canister 72 includes a gas cylinder 74. The gas cylinder 74 communicates with the control 31, such that when the control 31 actuates the valve 30, it also actuates the gas cylinder 74 such that it begins to inject gas bubbles through a pin 76 into the liquid suppressor agent 28.

In sum, four embodiments have been disclosed wherein a feature is provided within the canister that will increase the production of bubbles within the liquid agent. As can be appreciated, the production of the bubbles preferably occurs at discharge, and during operation of the dispensing of the fire suppression materials toward the fire. Bubbles will form without the feature, as in the prior art. The features increase the number and rate of formation of such bubbles. The feature may be roughened surfaces (FIG. 1), a powder (FIG. 2), some included surface (FIG. 3), or actually a system for injecting bubbles (FIG. 4). Of course, these are examples, and other ways of increasing the formation of bubbles may also come within the scope of this invention.

While embodiments of this invention have been disclosed, a worker of ordinary skill in this art would recognize that certain modifications would come within the scope of this invention. For that reason, the following claims should be studied to determine the true scope and content of this invention.

What is claimed is:

1. A fire suppression cylinder comprising:

a valve at an outlet of a canister, and a control for said valve, said valve including a nozzle and an actuator for opening said valve and controlled by said control, said canister for receiving a liquid suppressor agent and a pressurized gas;

a feature within a portion of said canister that will receive the liquid suppressor agent, said feature for increasing the formation of gas bubbles within the liquid suppressor agent;

said feature is formed on an inner wall of at least a portion of said canister; and said feature being a roughened surface on said inner wall, and a detection system for detecting an event, and actuating said actuator upon detection of said event to open said valve and allow the liquid suppressor agent and pressurized gas to be discharged through the nozzle; and a height of said roughened surface on said inner wall is less than 1 mm.

2. The cylinder as set forth in claim 1, wherein said feature is formed only at a portion of said inner wall of said canister that will be associated with the approximate level of the liquid suppressor agent.

3. The cylinder as set forth in claim 1, wherein the height of said roughened surface on said inner wall is between 0.1 mm and 0.5 mm.

4. The cylinder as set forth in claim 1, wherein said event includes an explosion.

5. The cylinder as set forth in claim 1, wherein said cylinder is intended to be fixed to a wall of a vehicle.

6. The cylinder as set forth in claim 1, wherein the actuator is one of a solenoid actuator, an electric protractor actuator, or a metron actuator.

7. The cylinder as set forth in claim 6, wherein the detection system is one of a single IR-sensor, a dual IR-sensor, a UV sensor, or a combined UV and IR sensor.

8. The cylinder as set forth in claim 1, wherein the detection system is one of a single IR-sensor, a dual IR-sensor, a UV sensor, or a combined UV and IR sensor.

9. A vehicle comprising:

a wall, with a fire suppression cylinder attached to said wall, the fire suppression cylinder including a valve at an outlet of a canister, and a control for said valve, said valve including a nozzle and an actuator for opening said valve and controlled by said control, said canister receiving a liquid suppressor agent and a pressurized gas, a feature within a portion of said canister that receives the liquid suppressor agent, said feature for increasing the formation of gas bubbles within the liquid suppressor agent, said feature being formed on an inner wall of at least a portion of said canister, said feature being a roughened surface on said inner wall; and a detection system for detecting an event, and actuating said actuator upon detection of said event to open said valve and allow the liquid suppressor agent and pressurized gas to be discharged through the nozzle; and a height of said roughened surface on said inner wall is less than 1 mm.

10. The vehicle as set forth in claim 9, wherein said feature is formed only at a portion of said inner wall of said canister that will be associated with the approximate level of the liquid suppressor agent.

11. The vehicle as set forth in claim 9, wherein the height of said roughened surface on said inner wall is between 0.1 mm and 0.5 mm.

12. The vehicle as set forth in claim 9, wherein said event includes an explosion.

13. The vehicle as set forth in claim 9, wherein the actuator is one of a solenoid actuator, an electric protractor actuator, or a metron actuator.

14. The vehicle as set forth in claim 13, wherein the detection system is one of a single IR-sensor, a dual IR-sensor, a UV sensor, or a combined UV and IR sensor.

15. The vehicle as set forth in claim 9, wherein the detection system is one of a single IR-sensor, a dual IR-sensor, a UV sensor, or a combined UV and IR sensor.

* * * * *